US006474946B2

(12) United States Patent
Kildea

(10) Patent No.: US 6,474,946 B2
(45) Date of Patent: Nov. 5, 2002

(54) ATTACHMENT AIR INLET CONFIGURATION FOR HIGHLY LOADED SINGLE CRYSTAL TURBINE BLADES

(75) Inventor: Robert J. Kildea, North Palm Beach, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/792,953

(22) Filed: Feb. 26, 2001

(65) Prior Publication Data

US 2002/0119046 A1 Aug. 29, 2002

(51) Int. Cl.[7] ..... B63H 1/14
(52) U.S. Cl. ..... 416/97 R; 416/241 B
(58) Field of Search ..... 416/97 R, 96 R, 416/95, 219 R, 223 A, 241 B; 415/114, 115

(56) References Cited

U.S. PATENT DOCUMENTS 3,574,482 A * 4/1971 Savage et al. ..... 416/96 R
4,073,599 A * 2/1978 Allen et al. ..... 416/97 R
5,601,399 A * 2/1997 Okpara et al. ..... 415/115
5,843,586 A * 12/1998 Schaeffer et al. ..... 416/241 B
5,975,851 A * 11/1999 Liang ..... 416/97 R

FOREIGN PATENT DOCUMENTS

GB 2224082 A * 4/1990

* cited by examiner

*Primary Examiner*—Edward K. Look
*Assistant Examiner*—Dwayne J. White
(74) *Attorney, Agent, or Firm*—Bachman & LaPointe, P.C.

(57) ABSTRACT

The present invention relates to an improved attachment air inlet configuration for a turbine blade. It defines several modifications that reduce attachment rib concentrated stresses in highly loaded, single crystal turbine blades that cause cracking in conventional blade inlet configurations. It desensitizes rib concentrated stresses to variations in secondary crystal orientation, permitting highly loaded single crystal blades to have random secondary crystal orientation for lower cost, or seed with any secondary orientation needed to solve other blade or manufacturing problems.

11 Claims, 2 Drawing Sheets

ATTACHMENT AIR INLET CONFIGURATION FOR HIGHLY LOADED SINGLE CRYSTAL TURBINE BLADES

BACKGROUND OF THE INVENTION

The present invention relates to an improved attachment air inlet configuration for highly loaded single crystal turbine blades.

High turbine blades in modern turbojet engines are usually made of cast alloys of nickel which are specially formulated to be solidified as a single crystal. These alloys have a crystal structure which has very directional properties. The modulus of elasticity can vary more than 2 to 1 depending on the direction. The highest is across the corners of the crystallographic cube, the lowest is parallel to the edges of the crystallographic cube. Other properties such as Poisson's ratio vary dramatically as well.

These blades require considerable cooling air to survive because the gaspath temperatures are well above the melting point of the blade material. Cooling air must be supplied through the attachment area which is typically a firtree shape to retain the blade within the disk broach slots which have a mating firtree shape. As the size and weight of the airfoil increases, the crushing load of the retention forces apply high compressive forces across the air passages which must be resisted by compressive stress in the ribs which separate the individual air passages.

The highly directional properties of the single crystal alloy cause very high concentrated stresses in the ribs between the air passages. The concentrated stress at a point in a part made of a single crystal alloy may be described as follows:

Concentrated stress at a point=[P/A +/− Mc/I] *Kt*kc where:

[P/A +/− Mc/I]=nominal section stresses at a point;

Kt=local stress multiplier due to local geometry for equiax materials; and

Kc=local stress multiplier due to overall part geometry and crystallographic orientation relative to that geometry.

Conventional flow passages and rib geometry produce very high concentrated stresses in modern blades which have both high radial loads and high crushing loads on the attachment. These high stresses cause plastic compressive redistribution of stress which results in tensile stresses on parts of the compressive ribs and rib cracking. Conventional attachments prove to be very sensitive to Kc effects.

SUMMARY OF THE INVENTION

Accordingly, it is an object of the present invention to provide an improved attachment air inlet configuration having an attachment area with a core/rib configuration which reduces the concentrated stresses while maintaining required flow and pressure loss parameters in cooling passages.

It is a further object of the present invention to provide an improved attachment air inlet configuration which solves the rib stress problem without increasing the overall size and weight of the attachment and the supporting disk.

The foregoing objects are achieved by the attachment air inlet configuration of the present invention.

In accordance with the present invention, an attachment air inlet configuration for a turbine blade comprises an attachment having a root portion with a center plane and a plurality of inlets in the root portion of the attachment communicating with at least two flow passageways in the blade. Each of the inlets communicates with a feed cavity and receives a cooling fluid such as cooling air. Each of the inlets has a non-circular shape with a major axis, which major axis is substantially normal to a central axis of the root portion center plane.

Other details of the attachment air inlet configuration of the present invention, as well as other objects and advantages attendant thereto, are set forth in the following detailed description and the accompanying drawings in which like reference numerals depict like elements.

DETAILED DESCRIPTION OF THE PREFERRED EMBODIMENT(S)

Figure 1:
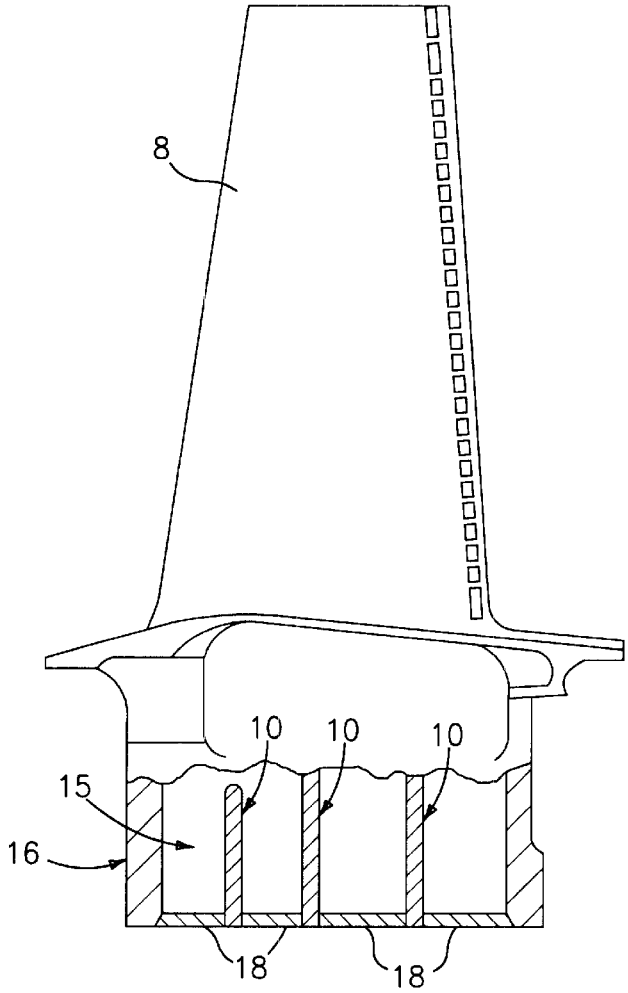
FIG. 1 (PRIOR ART)
FIG. 1 shows a conventional attachment air inlet configuration in partial section.
Figure 2:
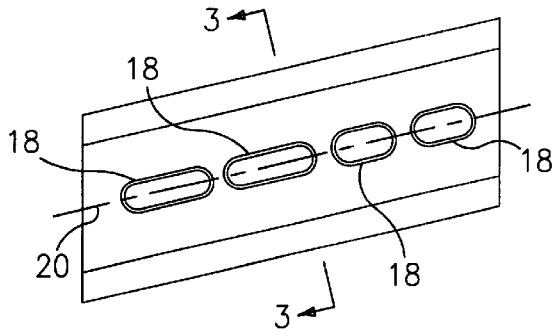
FIG. 2 (PRIOR ART)
FIG. 2 shows a bottom view of the attachment and air inlet configuration of FIG. 1.
Figure 3:
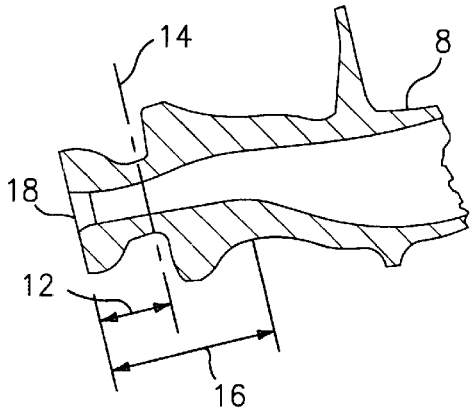
FIG. 3 (PRIOR ART)
FIG. 3 is a sectional view taken along lines 3—3 in FIG. 2.

Referring now to the drawings, FIGS. 1–3 show a conventional attachment air inlet configuration for a blade 8 having a firtree shaped attachment area 16 for joining the blade 8 to a disk structure (not shown). As shown in FIGS. 1 and 3, the attachment area 16 has a minimum neck section 14 and a core section 15 which includes a plurality of ribs 10 defining air inlets 18 for supplying cooling air to passageways in the blade 8. As can be seen from FIG. 1, the ribs 10 have a substantially uniform thickness in the regions above and below the minimum neck section 14. In this type of attachment air inlet configuration, the ribs 10 are highly stressed in compression in the region 12 below the minimum neck section 14 of the firtree shaped attachment area 16. This is where the concentrated stresses are highest due to both the local geometry effects (Kt) and where the directional stiffness effects (Kc) are most pronounced. As can be seen from FIG. 2, the air inlets 18 in this configuration have an elongated shape with a major axis which lies along the central axis 20 of the blade root center plane.

Figure 4:
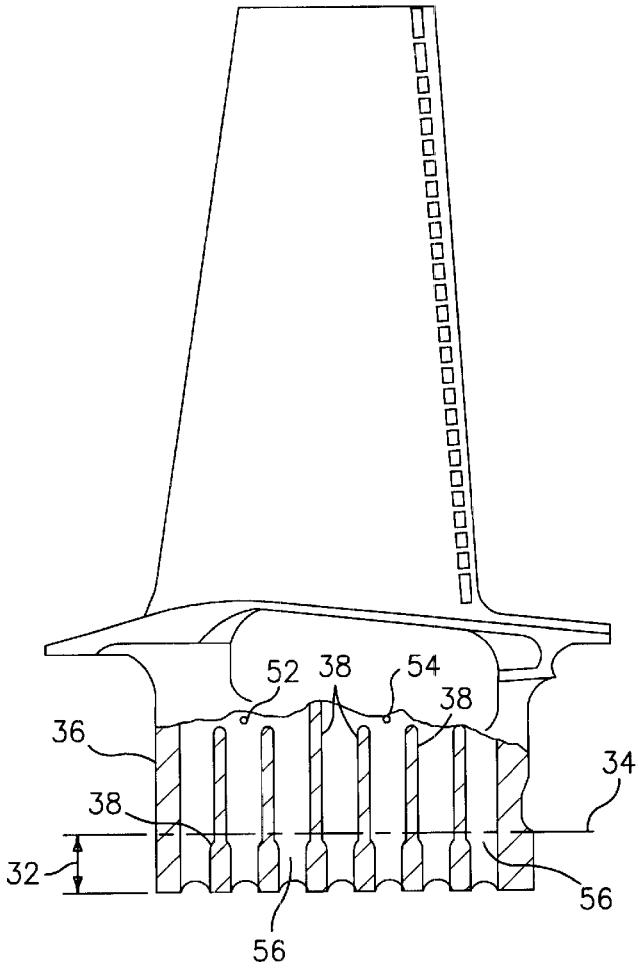
FIG. 4 is a side view of an attachment air inlet configuration in accordance with the present invention in partial cross section.
Figure 5:
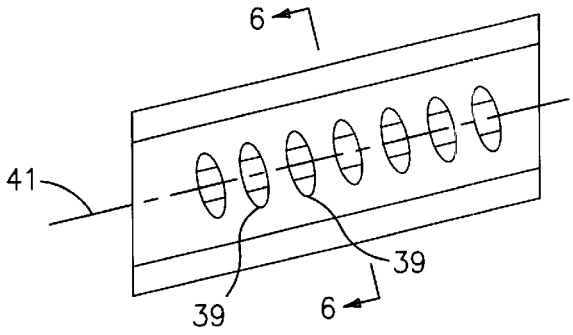
FIG. 5 is a bottom view of the attachment and air inlet configuration of FIG. 4.
Figure 6:
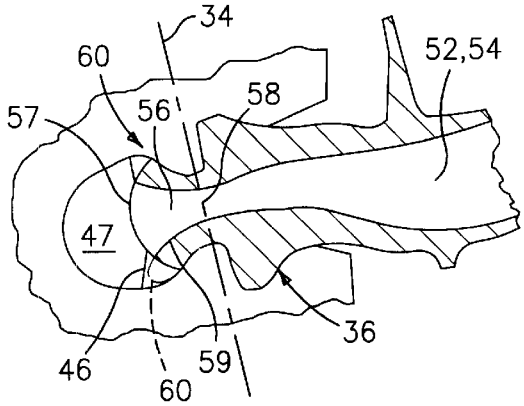
FIG. 6 is a sectional view taken along lines 6—6 in FIG. 5.

Referring now to FIGS. 4–6, the attachment air inlet configuration 39 of the present invention alters the core configuration in the lowest firtree area 32, below the minimum section 34 of the firtree 36. The attachment air inlet configuration of the present invention provides an increased number of ribs 38 in the core section for defining an increased number of air inlets 39. As can be seen from FIG. 5, the air inlets 39 each have an elliptical shape with the major axis of each air inlet 39 being normal to the blade root center plane 41. Each of the inlets 39 is in communication with, and receives a cooling fluid, such as air, from an inlet plenum 47. The total thickness and cross sectional area of all of the ribs 38, above the minimum section 34, remains unchanged to preserve the flow area for the cooling air.

In the present invention, more rib cross sectional area below the minimum neck section 34 has been provided by making each of the ribs 38 longer near the blade root center plane 41 and by providing each of the ribs 38 in a region below the minimum neck section with a variable thickness greater than the thickness in the region above the minimum neck section. One of the ribs 38 is a main rib which divides the core section into two flow passages 52 and 54. The other ribs 38 are equally spaced in the two flow passages 52 and 54 and form a series of inlet channels 56. This produces a series of core sections at the minimum neck section 34 which are close to an aspect ratio of 1. This also allows the development of inlet channels 56 below the minimum neck section 34 which comprise an array of nearly elliptical sections whose major axis is normal to the blade root center plane.

The increased length of the ribs 38 tends to decrease the flow area in the inlet plenum 47 below the blade attachment. To address this, the attachment 36 in the present invention is provided with a rounded lower surface 46 to provide additional area at the side corners 60 to compensate for the flow area which has been lost as a result of the increased length of the ribs 38 near the center plane 41.

In order to define the transition surfaces of the core air passages between the bottom of the blade root 57 and the minimum neck section 34, two profiles were generated for each surface. One profile was on the blade root center plane 41 and the other was on a plane normal to the blade root center plane, through the center of the elliptical section. The top of each profile is determined by the minimum neck section 34. Several additional sections were constructed parallel to and below the minimum neck section to conform to the vertical profiles. Each was defined, as being almost elliptical with consideration to the draft needs for ceramic core production. Finally, 3D surfaces were generated (from the sections and profiles) to define the transition region of the core air passages. This produced smooth transition surfaces, such that the flow area is gradually reduced from the large ellipses at the cooling air inlet 39 to the existing flow area at the minimum area neck section 34. In other words, each of the inlet channels has a first flow area at the minimum neck section and a larger variable flow area beneath the minimum neck section.

By providing the attachment air inlet configuration of the present invention, the entry loss for the cooling air flow is reduced by providing a larger flow area and greater lip perimeter at the point where the flow turns to enter the core area at the bottom 57 of the attachment. This reduction in entry loss compensates for the higher internal flow loss caused by the increase in wetted perimeter of the flow cavities due to the greater number of smaller flow passages.

Blades made of a single crystal structure typically orient one of the low modulus directions radially in order to reduce the vibration frequency of the blade in first bending mode. The parts may be seeded during the casting process to define the secondary crystallographic orientation (rotation of the crystal around the primary orientation direction), but this increases the cost.

Stress in the blade attachment is influenced by the secondary orientation of the crystal (Kc effect). Traditional core/rib configurations, such as shown in FIGS. 1–3, are highly influenced by the Kt and Kc effects and, in large very high loaded attachments, the blade would have to be seeded to minimize the compressive stress and to prevent rib cracking. The optimum rib geometry would depend on the secondary orientation chosen. This is because the Kc term in the stress equation in large measure is the result of the load path changing as the secondary orientation is changed.

The configuration described herein has been shown by 3D stress analysis to be relatively insensitive to secondary orientation. This benefit can be taken in either of two ways: (a) allow random secondary orientation and effect a cost savings; and (b) use secondary crystal orientation to solve other stress or manufacturing problems.

The attachment air inlet configuration of the present invention minimizes the maximum compressive stress in the attachment due to the combined effects of Kt (local geometry) and Kc (overall geometry and directionally variable modulus) in the compressive ribs of a blade attachment. The configuration of the present invention provides an efficient (minimum weight) solution to the combined problems of cooling flow pressure drop, highly concentrated compressive stress and tensile cracking of the compressive ribs due to plastic redistribution of the single crystal material along the cubic and octahedral shear planes of the material. The rib geometry in the configuration of the present invention is relatively insensitive to secondary crystal orientation which allows the part to use random secondary crystal orientation (minimize cost) or specify a crystal orientation to solve problems in other areas of the blade.

While it is preferred to have only one main rib which forms two flow passageways in the blade, it is possible to form more than two flow passageways with the ribs 38 if desired.

It is apparent that there has been provided in accordance with the present invention an attachment air inlet configuration for highly loaded single crystal turbine blades which fully satisfies the objects, means and advantages set forth hereinbefore. While the present invention has been described in the context of specific embodiments thereof, it should be apparent that other modifications, alternatives, and variations will become apparent to those skilled in the art having read the foregoing description. Therefore, it is intended to embrace those modifications, alternatives, and variations as fall within the broad scope of the appended claims.

What is claimed is:

1. An attachment air inlet configuration for a turbine blade comprising:

an attachment having a root portion with a center plane;

a plurality of inlets in said root portion of said attachment communicating with at least two flow passageways in said blade;

each of said inlets having a non-circular shape with a major axis; and said major axis being substantially normal to said root portion center plane.

2. An attachment air inlet configuration according to claim 1, wherein said attachment has a firtree configuration with a minimum neck section and wherein said blade has a plurality of ribs extending along an axis substantially perpendicular to said root portion center plane to define a plurality of inlet channels communicating with said inlets.

3. An attachment air inlet configuration according to claim 2, wherein each of said inlet channels has an elliptical shape.

4. An attachment air inlet configuration according to claim 2, wherein each of said inlet channels has a first flow area at said minimum neck section and a variable flow area larger than said first flow area beneath said minimum neck section.

5. An attachment air inlet configuration according to claim 2, wherein said attachment has a rounded lower surface.

6. An attachment air inlet configuration according to claim 2, further comprising each of said ribs having a first thickness in a region above the minimum neck section and a variable thickness greater than said first thickness in a region below said minimum neck section.

7. An attachment air inlet configuration according to claim 6, wherein said plurality of ribs include a central rib which forms two flow passageways in said blade and each of said inlet channels communicates with one of said flow passageways.

8. An attachment air inlet configuration according to claim 6, wherein each of said ribs occupies a first area in the region above said minimum neck section and a second area larger than said first area in the region below said minimum neck section.

9. An attachment air inlet configuration according to claim 8, further comprising each of said inlet channels having a curved transition section extending between a respective one of said inlets and said minimum neck section.

10. An attachment air inlet configuration according to claim 1, wherein said blade is a single crystal turbine blade.

11. An attachment air inlet configuration according to claim 10, wherein said single crystal turbine blade has a random secondary crystal orientation.

* * * * *

UNITED STATES PATENT AND TRADEMARK OFFICE

CERTIFICATE OF CORRECTION

PATENT NO. : 6,474,946 B2
DATED : November 5, 2002
INVENTOR(S) : Robert J. Kildea It is certified that error appears in the above-identified patent and that said Letters Patent is hereby corrected as shown below:

Column 1,
Line 4, after the title, a Government rights clause should be inserted as follows:

-- U.S. GOVERNMENT RIGHTS

The Government may have rights in this invention, pursuant to Contract No. F33657-91-C-0007, awarded by the United States Air Force. --

Signed and Sealed this

Seventh Day of October, 2003

JAMES E. ROGAN
*Director of the United States Patent and Trademark Office*